US005373266A

United States Patent [19]

Lenzing et al.

[11] Patent Number: 5,373,266

[45] Date of Patent: Dec. 13, 1994

[54] MICROSTRIP DIRECTIONAL COUPLER

[75] Inventors: Erik H. Lenzing, Middletown; Roland Cadotte, Jr., Freehold; Michael Cummings, Howell, all of N.J.

[73] Assignee: The United States of America as represented by the Secreatry of the Army, Washington, D.C.

[21] Appl. No.: 149,254

[22] Filed: Nov. 9, 1993

[51] Int. Cl.[5] ..... H01P 5/18

[52] U.S. Cl. ..... 333/116; 333/238

[58] Field of Search ..... 333/116, 238, 246

[56] References Cited

U.S. PATENT DOCUMENTS 3,332,039 7/1967 Oh ..... 333/116

FOREIGN PATENT DOCUMENTS 1319119 6/1987 U.S.S.R. ..... 333/116

OTHER PUBLICATIONS

Podell, Allen, "A High Directivity Microstrip Coupler Technique", *IEEE GMTT*, May, 1970.

Tremblay, M. D., "Design of High Directivity Microstrip Quarter Wavelength Directional Coupler With Small Coupling Coefficients", *Bell Laboratories*, Aug. 6, 1973.

Rehnmark, Meansler-*Folded Coupled Lines*, IEEE Trans. on MTT, vol. MTT-26, No. 4, Apr. 1978, pp. 225-231.

*Primary Examiner*—Paul Gensler

*Attorney, Agent, or Firm*—Michael Zelenka; William H. Anderson

[57] ABSTRACT

A directional coupler is formed with adjacent edges of its microstrips following curved paths having reversals in curvature such as a series of sine waves or half circles.

5 Claims, 2 Drawing Sheets

MICROSTRIP DIRECTIONAL COUPLER

GOVERNMENT INTEREST

The invention described herein may be manufactured, used, and licensed by or for the Government for governmental purposes without the payment to us of any royalty thereon.

FIELD OF THE INVENTION

This invention is in the field of directional couplers.

BACKGROUND OF THE INVENTION

As described in an article by Alan Podell, entitled "A High Directivity Microstrip Coupler Technique" that appeared in the May, 1970, issue of IEEE G-MTT, and in an article by M. D. Tremblay entitled "Design of High Directivity Microstrip Quarter Wavelength Directional Coupler with Small Coupling Coefficients", that appeared in the Aug. 6, 1973 issue of Bell Laboratories, directive microstrip couplers may be comprised of a substrate of insulating material having a first conductive area, which serves as a ground plane, on one side and second and third patterned conductive areas on the other. The outside edges of the second and third areas are straight parallel lines, and the adjacent edges are spaced parallel "wiggly" paths in the form of sawteeth. A terminal is located at the end of the second and third areas.

In operation of the coupler, microwave energy coupled to a terminal at one end of the second area travels to the terminal at the other end of that area with part of the energy coupled to an output terminal at one end of the third area. The remaining terminal of the third area is connected to ground via a resistive characteristic impedance. Microwave energy propagates along the microstrip areas in two modes, an even mode that travels equally distributed along the inner and outer edges, and an odd mode that propagates primarily along the adjacent edges that are in the form of sawteeth. The odd mode travels faster than the even mode, but both arrive at the output terminal at the same time because of the length of the sawtooth paths is greater than the length of the straight line paths.

One disadvantage of the directional microwave coupler just described is that the large current density at the discontinuity points or corners of each saw tooth causes relatively large resistive losses. Another disadvantage is that RF energy is radiated at these same points, particularly at high microwave or millimeter wave frequencies.

BRIEF SUMMARY OF THE INVENTION

In accordance with this invention, the aforesaid disadvantages are largely overcome by eliminating the discontinuities or corners. This can be done by making the adjacent edges of the second and third conductive areas follow a curved path with a number of reversals of curvature. The path can be sinusoidal, or it can be comprised of successive semicircles or half circles. It would not be necessary for each sinusoid or half circle to be the same, and different curved paths can be used.

A further advantage of a curved path such as a sine wave or half circle "wiggle" or undulation for the adjacent edges of the second and third conductive areas is that the path length per "wiggle" or undulation is greater than in a sawtooth pattern so that fewer reversals of curvature are required. Also, the current density at each reversal in curvature is significantly less than the case of a sawtooth path, thereby further reducing power loss and RF radiation.

BRIEF DESCRIPTION OF THE DRAWINGS

Various embodiments of the invention are described below with reference to the drawings, in which like items are indicated by the same reference designation, wherein.

DETAILED DESCRIPTION OF THE INVENTION

Figure 1:
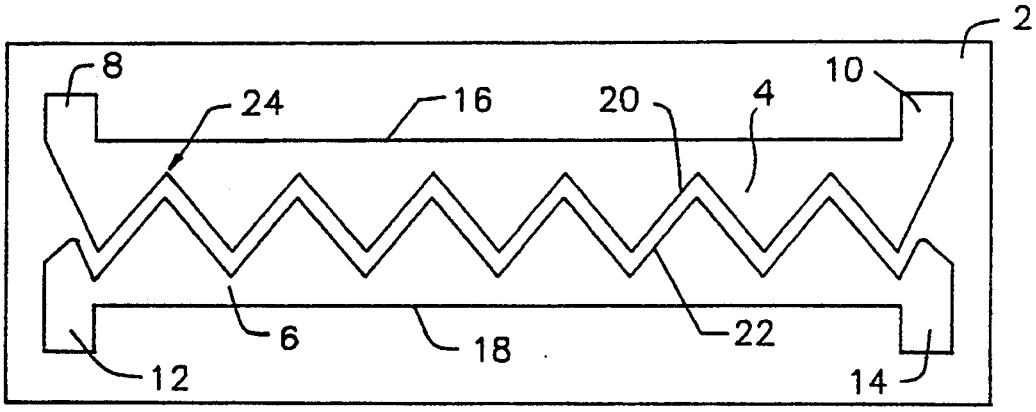
FIG. 1 PRIOR ART
FIG. 1 is a top view of a microwave directional coupler of the prior art.

In a microwave directional coupler of the prior art shown in FIG. 1, the top 2 of a substrate is shown as having metallic microstrips 4 and 6 thereupon. Microwaves applied to an input terminal 8 flow toward an output terminal 10 at which they are reflected to another output terminal 12. In an actual circuit, the fourth terminal 14 is connected to ground via a characteristic impedance, not shown.

Figure 2:
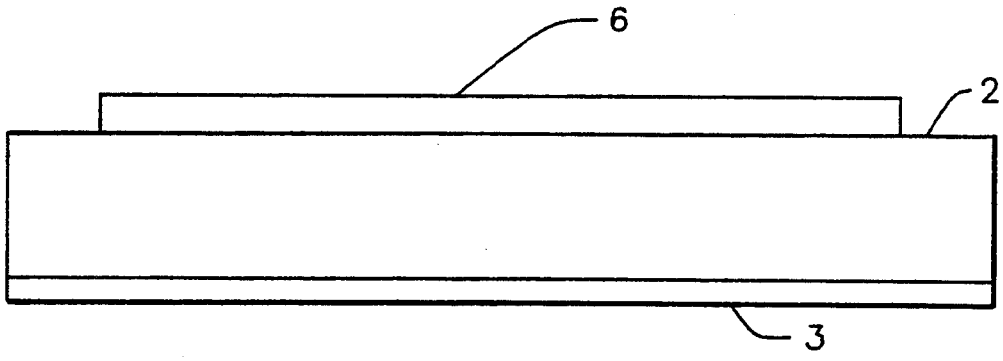
FIG. 2 is a side view of FIG. 1.

The substrate 2 is made of electrically insulating material. A metallic layer 3 is formed on its bottom surface so as to serve as a ground plane, as shown in FIG. 2.

As explained in the articles referred to above, the microwave energy flows by even and odd modes. The even mode flows along the straight remote edges 16 and 18 of the microstrips 4 and 6, respectively, and the odd mode flows along the adjacent sawtooth edges 20 and 22. The greater length of the path formed by the sawtooth edges 20 and 22 with respect to the length of the path formed by the straight edges 16 and 18 compensates for the fact that the odd mode travels faster than the even mode so that the microwave arrive at the output terminals 10 and 12 in phase.

As previously noted, the current density at the apexes of the sawteeth, such as indicated at 24, is greater than at other points, so as to cause loss of power by $I^2R$ losses and RF radiation.

Figure 3:
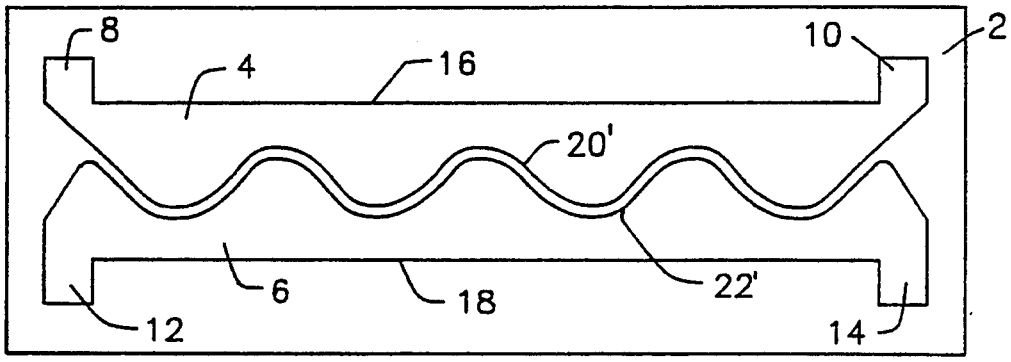
FIG. 3 is a top view of a microwave directional coupler of this invention employing a sinusoidal path.
Figure 4:
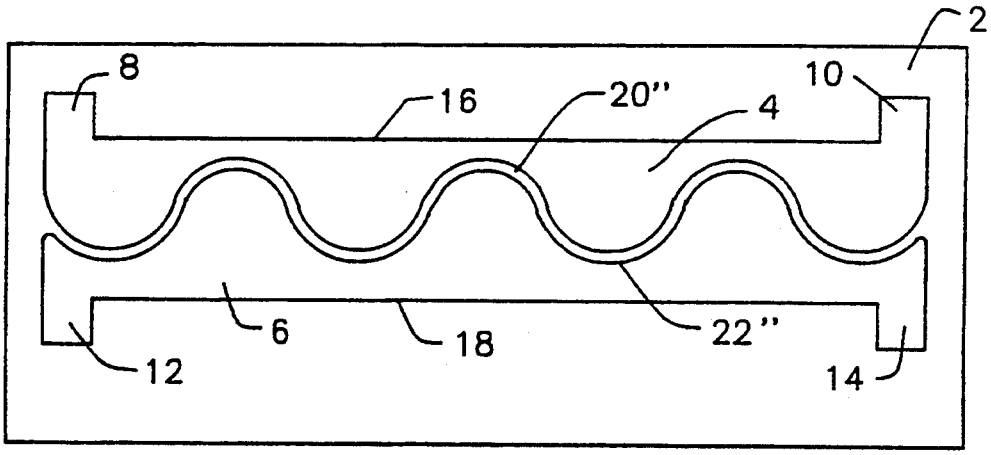
FIG. 4 is a top view of a microwave directional coupler of this invention employing a path comprised of a series of half circles.

Reference is now made to FIG. 3 in which a top view of a coupler incorporating one form of this invention is illustrated. The difference lies in the fact that the adjacent edges of the microstrips 4 and 6 follow a wiggly curved path having reversals in curvature. In this particular specie of the invention the curved path is sinusoidal, as indicated at 20' and 22' but as shown in the specie of FIG. 4, the adjacent edges may follow curved paths 20'' and 22' that are comprised of a series of half circles. It is not necessary that the sinusoids formed by the paths 20' and 22' of FIG. 3 have the same amplitude or length. Similarly, the half circles of the paths 20'' and 22'' of FIG. 4 could have different radii. Other forms of curved paths could be used.

An advantage of this invention is that the curved paths 20' and 22' of FIG. 3 and 20'' and 22' of FIG. 4, are free of the corners or angles such as 24 of FIG. 1. In order to have wiggly paths, there must be reversals in direction, but an angular reversal in direction such as indicated at 24 decreases the amount of area per unit of path length so as to increase the current density, and, as previously stated this increases the $I^2R$ losses as well as the losses by RF radiation.

Furthermore, the path length along curved adjacent edges is greater for a given distance between the input terminal 8 and the output terminal 10 so that fewer wiggles can be used, thereby further decreasing $I^2R$ and radiation power losses.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A microstrip directional coupler including:

a substrate of electrically insulating material;

a first conductive area on one surface of said substrate;

second and third patterned conductive areas on the other side of said substrate; and adjacent edges of said second and third conductive areas being spaced from each other and lying along respective parallel curved lines having a plurality of reversals in curvature, wherein said curved lines follow paths including successive half circles joined together.

2. A microstrip directional coupler as set forth in claim 1, further including:

terminals at opposite ends of each of said second and third conductive areas.

3. A microstrip directional coupler comprising:

a substrate of electrically insulating material;

a first conductive area on one side of said substrate;

second and third patterned conductive areas on the other side of said substrate;

the remote edges of said second and third conductive areas being parallel straight lines;

the adjacent edges of said second and third conductive areas lying along spaced curved lines having a plurality of reversals of curvature; and terminals located at opposite ends of said second and third areas.

4. A microstrip directional coupler as set forth in claim 3, wherein said curved lines follow a sinusoidal path.

5. A microstrip directional coupler as set forth in claim 3, wherein said curved lines follow paths including successive half circles joined together.

* * * * *